US009564278B2

(12) United States Patent
Harrington

(10) Patent No.: US 9,564,278 B2
(45) Date of Patent: Feb. 7, 2017

(54) PYROTECHNICALLY ACTUATED SWITCH

(71) Applicant: Goodrich Corporation, Charlotte, NC (US)

(72) Inventor: David Harrington, Fairfield, CA (US)

(73) Assignee: Goodrich Corporation, Charlotte, NC (US)

( * ) Notice: Subject to any disclaimer, the term of this patent is extended or adjusted under 35 U.S.C. 154(b) by 163 days.

(21) Appl. No.: 14/460,200

(22) Filed: Aug. 14, 2014

(65) Prior Publication Data

US 2016/0049271 A1 Feb. 18, 2016

(51) Int. Cl.

| | |
|---|---|
| ***H01H 37/32*** | (2006.01) |
| ***H01H 37/04*** | (2006.01) |
| ***H01H 39/00*** | (2006.01) |
| *H01H 37/34* | (2006.01) |

(52) U.S. Cl.

CPC ..... *H01H 37/32* (2013.01); *H01H 37/04* (2013.01); *H01H 39/004* (2013.01); *H01H 37/34* (2013.01); *H01H 2239/06* (2013.01)

(58) Field of Classification Search

CPC ..... H01H 37/32; H01H 37/04; H01H 39/004; H01H 2239/06; H01H 37/34; H01H 85/11

USPC ..... 337/413, 401, 414

See application file for complete search history.

(56) References Cited

U.S. PATENT DOCUMENTS

| | | | | |
|---|---|---|---|---|
| 3,274,363 | A | 9/1966 | McGirret et al. | |
| 3,475,572 | A | 10/1969 | Voyentzie et al. | |
| 3,909,567 | A | 9/1975 | Delgendre et al. | |
| 4,052,690 | A * | 10/1977 | Jacoby | H01H 37/76 116/106 |
| 4,065,741 | A * | 12/1977 | Sakamoto | H01H 37/70 337/407 |
| 4,150,266 | A * | 4/1979 | Patrichi | H01H 39/004 102/202.14 |
| 4,734,823 | A * | 3/1988 | Cunningham | H01C 7/126 361/117 |
| 5,262,753 | A | 11/1993 | Duplaix | |
| 6,107,581 | A * | 8/2000 | Tanigawa | H01H 3/503 200/82 D |
| 6,204,747 | B1 | 3/2001 | Kitchens | |
| 6,483,420 | B1 * | 11/2002 | Takahashi | H01H 85/044 180/274 |
| 2010/0328014 | A1 * | 12/2010 | Suzuki | H01H 9/12 337/30 |

OTHER PUBLICATIONS

Extended European Search Report dated Dec. 4, 2015 in European Application No. 15180970.4.

* cited by examiner

*Primary Examiner* — Stephen Sul
(74) *Attorney, Agent, or Firm* — Snell & Wilmer L.L.P.

(57) ABSTRACT

A switch may comprise a metal plate. A eutectic alloy may be proximate to the metal plate. An insulating material may be proximate to the insulating material. The insulating material may include a recess in the insulating material adjacent the eutectic alloy. A lead may be fixed in place by the insulating material. A first end of the lead is exposed from the insulating material by the recess.

15 Claims, 2 Drawing Sheets

PYROTECHNICALLY ACTUATED SWITCH

FIELD OF INVENTION

The present disclosure relates to switches, and, more specifically, to a pyrotechnically actuated switch.

BACKGROUND OF THE INVENTION

Aircraft may rely on pyrotechnic switches to switch electrical circuits open or closed in response to an ejection or similar event occurring. The switches may be subject to extreme forces and vibration from when a pilot ejects to when an aircraft crashes, for example. When a switch is actuated, the connection may bounce open and closed to ambient vibration or forces. The bouncing may result in the undesirable effect of an inconsistent connection and cause the switch to function unreliably.

SUMMARY OF THE INVENTION

A switch may comprise a metal plate. A eutectic alloy may be proximate to the metal plate. An insulating material may be proximate to the eutectic alloy. The insulating material may include a recess in the insulating material adjacent the eutectic alloy. A lead may be fixed in place by the insulating material. A first end of the lead may be in the recess.

In various embodiments, the switch may further comprise a cylindrical case enclosing the metal plate, the eutectic alloy, and the insulating material and partially enclosing the lead. The case may comprise stainless steel. The insulating material may comprise an acetyl resin. The eutectic alloy may comprise an indium alloy. The melting point of the eutectic alloy may be between 200 and 300 degrees Fahrenheit. The plate may comprise copper. The plate may be configured to melt the eutectic alloy and slide towards the lead.

A pyrotechnic switching system may comprise a detonation transfer assembly configured to create an air signal. A pyrotechnically actuated switch may be coupled to the detonation transfer assembly. The pyrotechnically actuated switch may comprise a plate and a eutectic alloy adjacent the plate. A lead may be adjacent the eutectic alloy with an opening between the eutectic alloy and the lead. The plate may be configured to press the eutectic alloy into the opening to contact the lead.

In various embodiments, the pyrotechnic switching system may further comprise an insulating material adjacent the eutectic alloy. The insulating material may at least partially fix the lead in place. An end of the lead may be exposed from the insulating material by a recess in the insulating material adjacent the eutectic alloy. A cylindrical case may at least partially enclose the plate, the eutectic alloy, and the lead. The eutectic alloy may comprise an indium alloy. The melting point of the eutectic alloy may be between 200 and 300 degrees Fahrenheit. The plate may comprise copper.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with this invention and the teachings herein. Thus, the detailed description herein is presented for purposes of illustration only and not of limitation. The scope of the invention is defined by the appended claims. For example, the steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Figure 1A:
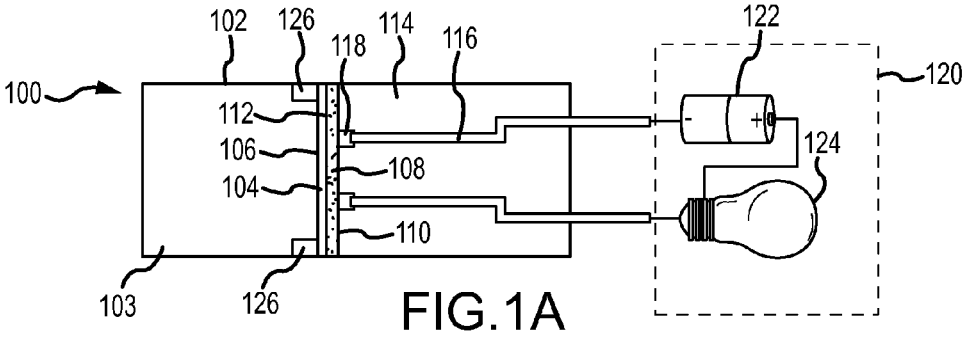
FIG. 1A illustrates a pyrotechnically actuated switch in an open position, in accordance with various embodiments.

FIG. 1A illustrates a pyrotechnically actuated switch in a starting state, in accordance with various embodiments. Pyrotechnically actuated switch 100 may comprise a casing 102. Casing 102 may be made from a metal (e.g., stainless steel) or from any other material suitable to withstand the pressures and temperatures delivered by a detonation transfer assembly (DTA) mated with input 103 of casing 102. Casing 102 may have a circular, rectangular, triangular, polygonal, or irregular cross section to house pyrotechnically actuated switch 100. For example, casing 102 may be a cylindrical casing with a circular cross section.

In various embodiments, pyrotechnically actuated switch 100 includes input 103 for attachment to a detonation transfer assembly. Plate 104 has surface 106 exposed to input 103 and may separate input 103 from other components of pyrotechnically actuated switch 100 within casing 102. Plate 104 may be made of copper, silver, gold, or any other material suitable for conducting heat. The perimeter of surface 106 may be in contact with or nearly in contact with the inner wall of casing 102. Plate 104 may have a thickness from 0.002 inches to 0.01 inches (51 μm to 254 μm). Plate 104 may be in contact with a stopper 126 of casing 102. The perimeter of plate 104 may slideably engage the inner surface of casing 102 as the switch changes from an open position to a closed position.

In various embodiments, eutectic alloy 108 may be adjacent plate 104. Eutectic alloy 108 has surface 110 exposed from plate 104 and surface 112 in direct contact with plate 104. Eutectic alloy 108 may be an indium based eutectic alloy or any other metal alloy with a melting point from 150° F. to 400° F. (66° C. to 204° C.). In various embodiments, the melting point of eutectic alloy 108 may be from 200° F. to 300° F. (93° C. to 149° C.). Eutectic alloy 108 may be formed with a thickness of 0.001 inches to 0.01 inches (25 μm to 254 μm).

In various embodiments, insulating material 114 may be adjacent eutectic alloy 108. Insulating material may be an acetyl resin (e.g., Delrin®), a polymer (e.g., a thermoplastic polymer such as PEEK), a glass reinforced resin, ceramic, or any other insulator suitable to withstand the temperatures of eutectic alloy 108 reached in response to a detonation from a detonation transfer assembly. Leads 116 may extend through insulating material 114. Leads 116 may be partially fixed in place by insulating material 114. One end of leads 116 may protrude from casing 102. The other end of leads 116 may be exposed from insulating material 114 by opening or recess 118 in insulating material 114. Recess 118 may be aligned with leads 116. Recess 118 in insulating material 114 may provide a path for eutectic alloy 108 to flow into contact with leads 116. Recess 118 may have a depth of 0.002 to 0.01 inches (51 μm to 254 μm). Recess 118 may comprise a width or diameter sufficient to expose lead 116 and allow eutectic alloy 108 in a liquid state to at least partially fill recess 118.

In various embodiments, a circuit 120 may be attached to pyrotechnically actuated switch 100. Circuit 120 may include a source 122 and a load 124. Circuit 120 may be open when pyrotechnically actuated switch 100 may be in the opened state, prior to a detonation of a DTA. For example, circuit 120 may be a destruction mechanism for avionics or software in an aircraft. Circuit 120 may be configured to destruct in response to pyrotechnically actuated switch 100 closing. Pyrotechnically actuated switch 100 may be triggered by a DTA in response to a pilot ejecting from an aircraft, for example, in which case the destruction of sensitive information may be critical.

Figure 1B:
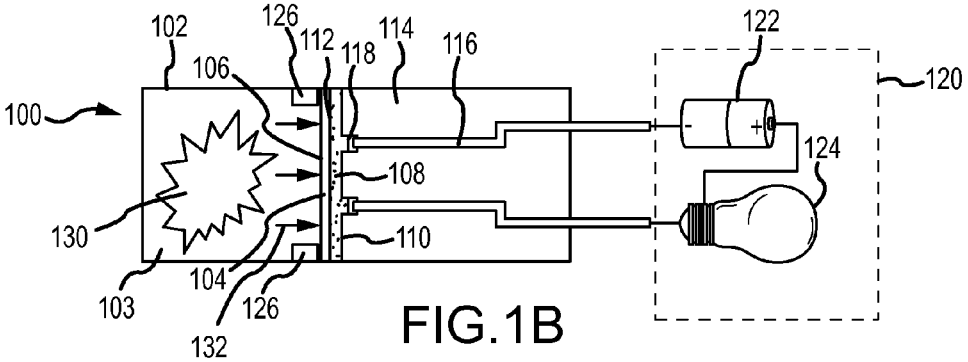
FIG. 1B illustrates a pyrotechnically actuated switch in fluid communication with a detonation transfer assembly, in accordance with various embodiments.

In various embodiments and in accordance with FIG. 1B, pyrotechnically actuated switch 100 may be in fluid communication with a DTA in response to a detonation 130. The DTA may contain an explosive (e.g., potassium picrate or hexanitrostilbene) to produce detonation 130 and create a high temperature and high pressure air signal 132 as an output. Detonation 130 creates high temperature and high pressure air signal 132. High temperature and high pressure air signal 132 may contact and press plate 104. Plate 104 may conduct heat from high temperature and high pressure air signal 132 to eutectic alloy 108 to melt eutectic alloy 108. Eutectic alloy 108 may be in a liquid state or may be otherwise malleable. Pressure from high temperature and high pressure air signal 132 presses against surface 106 of plate 104. Plate 104 may then press against eutectic alloy 108 to press eutectic alloy 108 into recess 118 in insulating material 114. Plate 104 may slide towards insulating material 114 to force eutectic alloy 108 into recesses 118. Eutectic alloy 108 may contact leads 116 to close circuit 120.

Figure 1C:
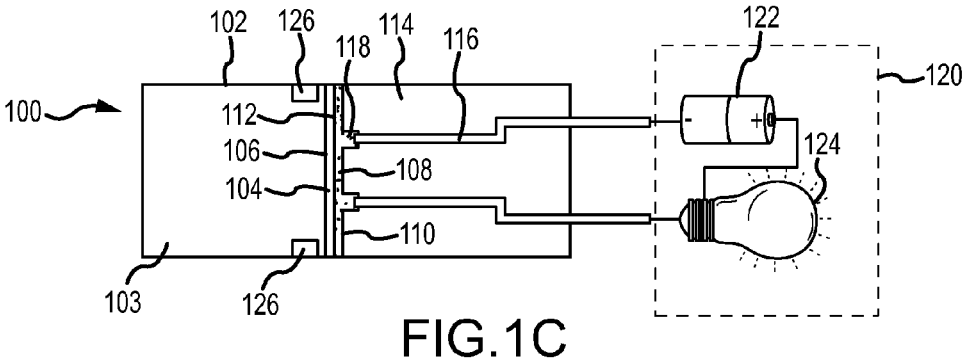
FIG. 1C illustrates a pyrotechnically actuated switch in a closed position, in accordance with various embodiments.

In various embodiments, and in accordance with FIG. 1C, pyrotechnically actuated switch 100 may be in a closed state in response to detonation 130 from a DTA. Eutectic alloy 108 may have been forced into recesses 118 while malleable or in a liquid state to at least partially fill recess 118 and contact leads 116. High temperature and high pressure air signal 132 may have subsided so that the temperature at surface 106 of plate 104 may be reduced. The temperature against plate 104 may drop below the melting point of eutectic alloy 108. Thus, eutectic alloy 108 may solidify while closing circuit 120. Thus, eutectic alloy 108 may permanently close circuit 120. Closed pyrotechnically actuated switch 100 may be less susceptible to vibrations as eutectic alloy is hardened in place contacting leads 116. Pyrotechnically actuated switch 100 may provide a reliable contact to close circuit 120 and may withstand ambient vibrations and forces as a result of eutectic alloy 108 hardening in contact with leads 116.

Figure 2A:
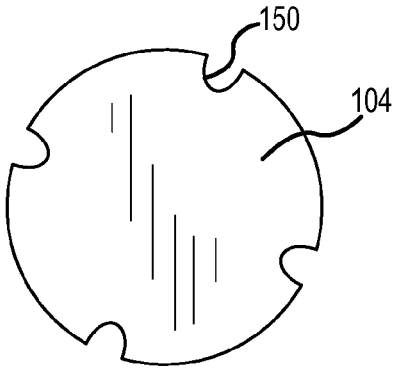
FIG. 2A illustrates a round metal plate with protrusions for use in a pyrotechnically actuated switch, in accordance with various embodiments.
Figure 2B:
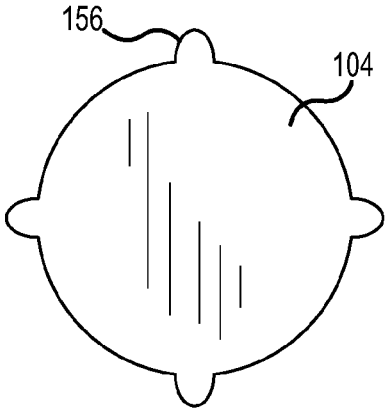
FIG. 2B illustrates a round metal plate with grooves for use in a pyrotechnically actuated switch, in accordance with various embodiments.

FIG. 2A illustrates a top view of a plate 104, in accordance with various embodiments. Plate 104 may include recesses 150. Recesses 150 may correspond with ridges in casing 102 to prevent plate 104 from tipping or rotating and prevent eutectic alloy 108 from flowing away from leads 116. FIG. 2B illustrates a top view of a plate 104, in accordance with various embodiments. Plate 104 may include protrusions 156. Protrusions 156 may correspond with grooves in casing 102 to prevent plate 104 from tipping or rotating and prevent eutectic alloy 108 from flowing away from leads 116. Stopper 126 may be an end of a groove corresponding to protrusion 156, for example.

Figure 3:
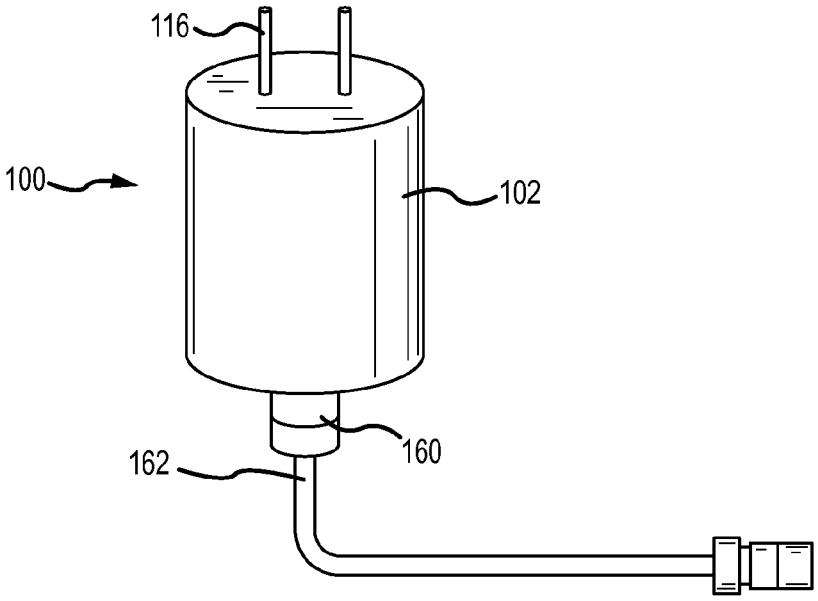
FIG. 3 illustrates an outer casing for a pyrotechnically actuated switch attached to a detonation transfer assembly, in accordance with various embodiments.

In accordance with various embodiments, and with reference to FIG. 3, pyrotechnically actuated switch 100 may include casing 102. Casing 102 may be made from metal (e.g., stainless steel). Casing 102 may comprise a cylindrical shape with leads 116 protruding from one end of casing 102. Input 103 of pyrotechnically actuated switch 100 may be coupled with detonation transfer assembly 162 at interface 160 at an end of casing 102 opposite the leads. Casing 102 may protect and environmentally seal pyrotechnically actuated switch 100.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A switch, comprising:

a metal plate;

an eutectic alloy proximate to the metal plate;

an insulating material proximate to the eutectic alloy and including a recess in the insulating material adjacent the eutectic alloy; and a lead fixed in place by the insulating material, wherein a first end of the lead is in the recess and electronically isolated from the eutectic alloy prior to a detonation; and wherein after the detonation the recess is no longer provided and the eutectic alloy contacts the lead.

2. The switch of claim 1, further comprising a cylindrical case enclosing the metal plate, the eutectic alloy, and the insulating material and partially enclosing the lead.

3. The switch of claim 2, wherein the cylindrical case comprises stainless steel.

4. The switch of claim 1, wherein the insulating material comprises an acetyl resin.

5. The switch of claim 1, wherein the eutectic alloy comprises an indium alloy.

6. The switch of claim 1, wherein a melting point of the eutectic alloy is between 200 and 300 degrees Fahrenheit.

7. The switch of claim 1, wherein the metal plate comprises copper.

8. The switch of claim 1, wherein the metal plate is configured to melt the eutectic alloy and slide towards the lead.

9. A pyrotechnic switching system, comprising:

a detonation transfer assembly including an explosive output configured to create an air signal;

a pyrotechnically actuated switch coupled to the explosive output of the detonation transfer assembly, the pyrotechnically actuated switch comprising:

a plate;

an eutectic alloy adjacent the plate; and a lead adjacent the eutectic alloy with a recess completely separating the eutectic alloy and the lead before a detonation; and after the detonation, the plate melts the eutectic alloy and presses the eutectic alloy into the recess to contact the lead in response to the air signal.

10. The pyrotechnic switching system of claim 9, further comprising an insulating material adjacent the eutectic alloy, wherein the insulating material at least partially fixes the lead in place.

11. The pyrotechnic switching system of claim 10, wherein an end of the lead is exposed from the insulating material by the opening between the eutectic alloy and the lead.

12. The pyrotechnic switching system of claim 9, further including a cylindrical case at least partially enclosing the plate, the eutectic alloy, and the lead.

13. The pyrotechnic switching system of claim 9, wherein the eutectic alloy comprises an indium alloy.

14. The pyrotechnic switching system of claim 9, wherein a melting point of the eutectic alloy between 200 and 300 degrees Fahrenheit.

15. The pyrotechnic switching system of claim 9, wherein the plate comprises copper.

* * * * *